US010520868B1

(12) United States Patent
Tomita

(10) Patent No.: US 10,520,868 B1
(45) Date of Patent: Dec. 31, 2019

(54) FIXING DEVICE AND IMAGE FORMING APPARATUS

(71) Applicant: FUJI XEROX CO., LTD., Tokyo (JP)

(72) Inventor: Yuhei Tomita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/294,863

(22) Filed: Mar. 6, 2019

(30) Foreign Application Priority Data

Sep. 13, 2018 (JP) ..... 2018-171624

(51) Int. Cl.
*G03G 15/20* (2006.01)

(52) U.S. Cl.
CPC ..... *G03G 15/2053* (2013.01); *G03G 15/2064* (2013.01); *G03G 2215/2032* (2013.01)

(58) Field of Classification Search
CPC ..... G03G 15/2053; G03G 15/2064; G03G 2215/2032
See application file for complete search history.

(56) References Cited

U.S. PATENT DOCUMENTS 9,720,361 B2 * 8/2017 Furuichi ..... G03G 15/2053
2005/0271408 A1 * 12/2005 Hayashi ..... G03G 15/2021 399/70
2007/0231026 A1 * 10/2007 Hayashi ..... G03G 15/2025 399/329
2008/0107436 A1 * 5/2008 Mikutsu ..... G03G 15/206 399/67
2015/0139705 A1 * 5/2015 Furuichi ..... G03G 15/2017 399/329
2016/0033911 A1 * 2/2016 Fukuhata ..... G03G 21/1647 399/329

FOREIGN PATENT DOCUMENTS

JP 2013-113932 6/2013
JP 2014-142398 8/2014

* cited by examiner

*Primary Examiner* — G. M. A Hyder
(74) *Attorney, Agent, or Firm* — JCIPRNET

(57) ABSTRACT

A fixing device includes a belt member, an inner circumferential rotating body, an outer circumferential rotating body, and a rotation starter. The belt member has an inner circumferential surface and an outer circumferential surface and fixes an image formed on a recording medium. The inner circumferential surface of the belt member is looped over the inner circumferential rotating body. The inner circumferential rotating body rotates the belt member. The outer circumferential rotating body is movable between a contact position at which the outer circumferential rotating body is in contact with the outer circumferential surface of the belt member and a separated position at which the outer circumferential rotating body is separated from the outer circumferential surface of the belt member. The outer circumferential rotating body rotates the belt member when the outer circumferential rotating body is disposed at the contact position. The rotation starter moves the outer circumferential rotating body toward the separated position and rotates the belt member by using the inner circumferential rotating body after the rotation starter has rotated the belt member by using the outer circumferential rotating body disposed at the contact position when the belt member is started to be rotated.

10 Claims, 7 Drawing Sheets

SEPARATED POSITION

PRESSING POSITION

CONTACT POSITION
60
61
62
63
64
65
PRESSING POSITION
CONTACT POSITION
SEPARATED POSITION

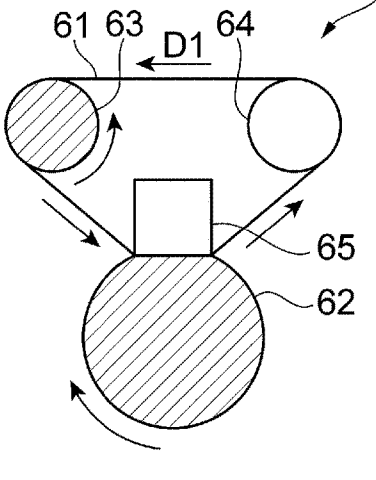
FIG. 5A
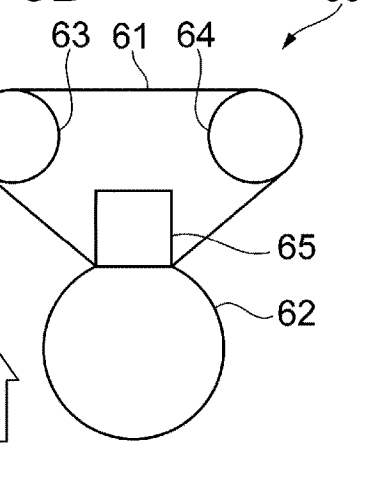
FIG. 5B
FIG. 5C
FIG. 5D
FIG. 5E

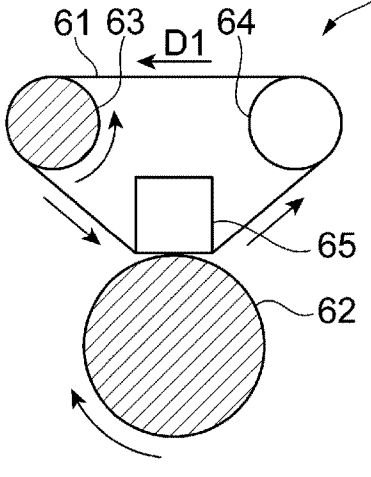
FIG. 6A
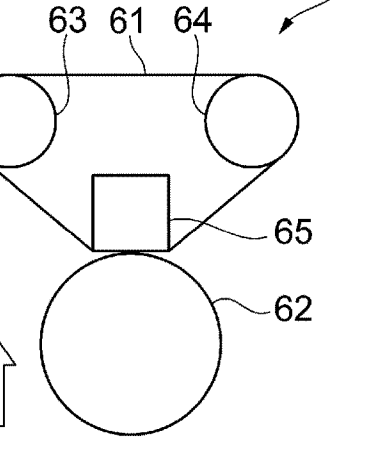
FIG. 6B
FIG. 6C
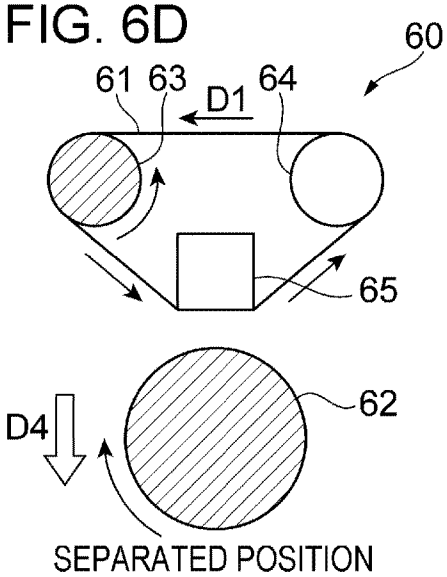
FIG. 6D
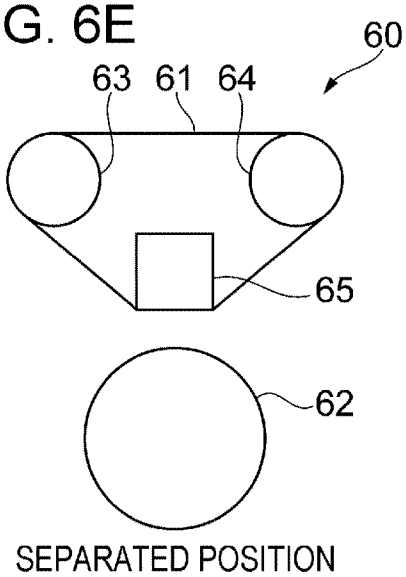
FIG. 6E 600
610
63
660
62
V1
V2(>V1)
D4
D5
CONTACT POSITION
SEPARATED POSITION

FIXING DEVICE AND IMAGE FORMING APPARATUS

CROSS-REFERENCE TO RELATED APPLICATIONS

This application is based on and claims priority under 35 USC 119 from Japanese Patent Application No. 2018-171624 filed Sep. 13, 2018.

BACKGROUND

(i) Technical Field

The present disclosure relates to a fixing device and an image forming apparatus.

(ii) Related Art

Japanese Unexamined Patent Application Publication No. 2014-142398 discloses the following technique: a fixing belt, a securing pad, a lubricant applicator, a pressure roller, and a heating roller are provided. The securing pad has a surface in contact with an inner surface of the fixing belt. The lubricant applicator applies a lubricant to the inner surface of the fixing belt. The pressure roller is disposed so as to be movable between a pressing position at which the pressure roller presses an outer surface of the fixing belt toward the surface of the securing pad and a non-pressing position at which the pressure roller does not press the fixing belt. The pressure roller is moved to the pressing position and rotated, thereby the pressure roller drives the fixing belt so as to circularly move the fixing belt, allows a medium holding an unfixed toner image to be received between the pressure roller and a fixing belt body, and cooperates with the fixing belt to fix the toner image to the medium. The heating roller is in contact with the inner surface of the fixing belt through the lubricant applied by the lubricant applicator. When the pressure roller is at the non-pressing position, the heating roller drives the fixing belt so as to circularly move the fixing belt.

Furthermore, Japanese Unexamined Patent Application Publication No. 2013-113932 discloses the following technique: a fixing device includes a pressure varying device and a controller. The pressure varying device includes, for example, an eccentric cam and a pressure lever with which pressure between a fixing belt and a pressure roller is able to be varied. The controller controls, in a standby state in which a recording medium does not pass through a fixing nip, the pressure varying device so as to reduce the pressure between the fixing belt and the pressure roller to a pressure smaller than a pressure during a heating process in which a toner image on the recording medium passing through the fixing nip is heated by the fixing belt and controls a induction heating unit and a fixing motor so as to rotate the fixing belt in a heated state.

SUMMARY

In some cases, a fixing device includes an inner circumferential rotating body and an outer circumferential rotating body. An inner circumferential surface of a belt member is looped over the inner circumferential rotating body and the belt member is rotated by the inner circumferential rotating body. The outer circumferential rotating body is able to be brought into contact with and separated from an outer circumferential surface of the belt member and rotates the belt member. With such a structure, when the belt member being stopped is rotated by the inner circumferential rotating body while the outer circumferential rotating body is separated from the belt member, slip may occur between the inner circumferential rotating body and the belt member.

Aspects of non-limiting embodiments of the present disclosure relate to suppressing of slip occurring between an inner circumferential rotating body and a belt member when the belt member is started to be rotated compared to the case where the belt member being stopped is rotated by the inner circumferential rotating body.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including a belt member, an inner circumferential rotating body, an outer circumferential rotating body, and a rotation starter. The belt member has an inner circumferential surface and an outer circumferential surface and fixes an image formed on a recording medium. The inner circumferential surface of the belt member is looped over the inner circumferential rotating body. The inner circumferential rotating body rotates the belt member. The outer circumferential rotating body is movable between a contact position at which the outer circumferential rotating body is in contact with the outer circumferential surface of the belt member and a separated position at which the outer circumferential rotating body is separated from the outer circumferential surface of the belt member. The outer circumferential rotating body rotates the belt member when the outer circumferential rotating body is disposed at the contact position. The rotation starter moves the outer circumferential rotating body toward the separated position and rotates the belt member by using the inner circumferential rotating body after the rotation starter has rotated the belt member by using the outer circumferential rotating body disposed at the contact position when the belt member is started to be rotated.

BRIEF DESCRIPTION OF THE DRAWINGS

Exemplary embodiments of the present disclosure will be described in detail based on the following figures, wherein:

FIGS. 5A to 5E illustrate operations of the fixing device at a time of a startup;

FIGS. 6A to 6E illustrate operations of the fixing device in the standby mode.

DETAILED DESCRIPTION

Exemplary embodiments of the present disclosure will be described below with reference to the accompanying drawings.

Image Forming Apparatus 1

Figure 1:
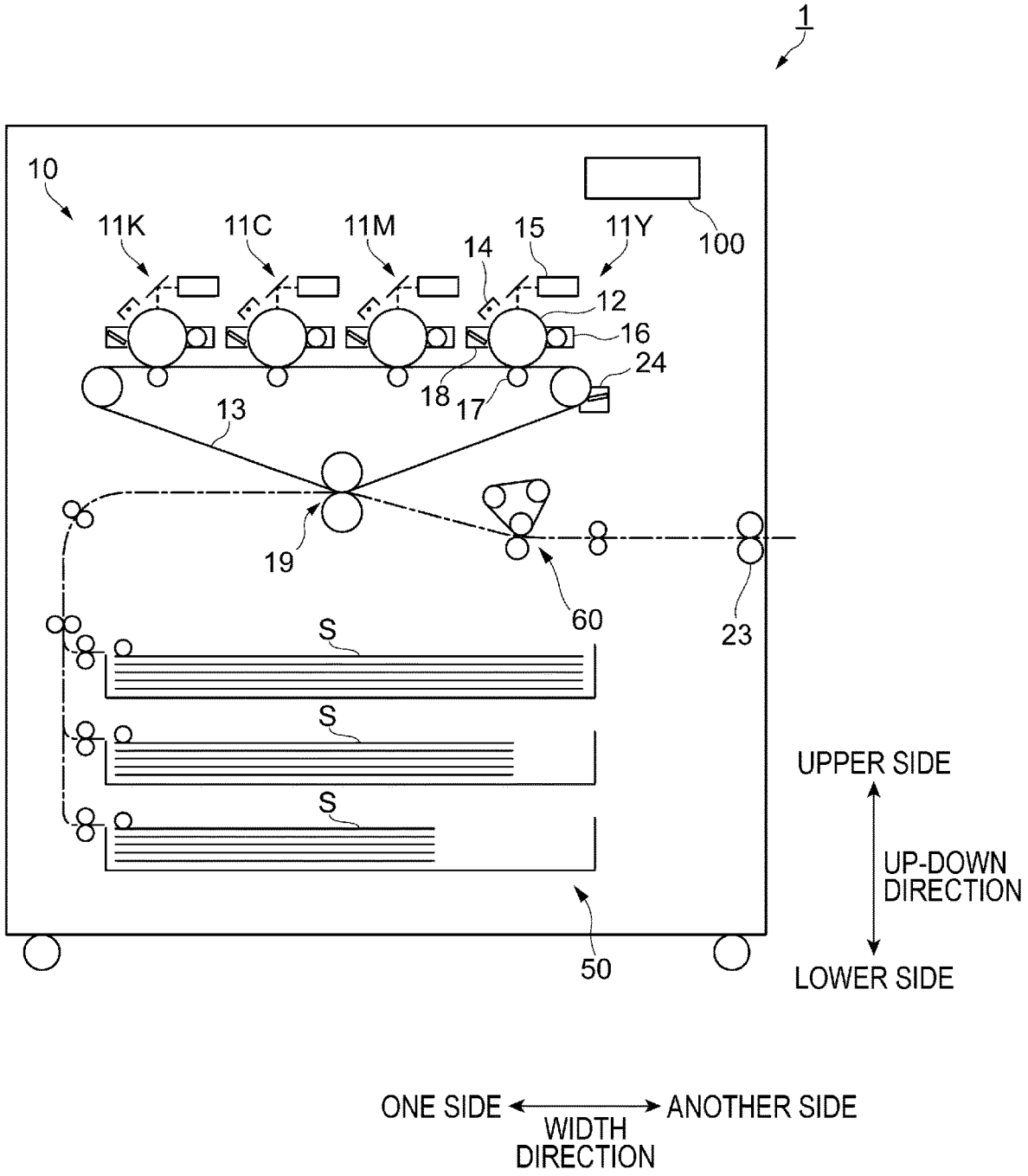
FIG. 1 is a schematic view of the structure of an image forming apparatus to which an exemplary embodiment is applied.

FIG. 1 is a schematic view of the structure of an image forming apparatus 1 to which the present exemplary embodiment is applied. The image forming apparatus 1 illustrated in FIG. 1 is a so-called tandem type color printer. The image forming apparatus 1 includes an image forming section 10, a sheet feed device 50, and a controller 100. The image forming section 10 forms images corresponding to image data of colors. The sheet feed device 50 supplies a sheet of paper S to the image forming section 10. The controller 100 controls operations of the entirety of the image forming apparatus 1.

Image Forming Section 10

The image forming section 10 includes four image forming units 11Y, 11M, 11C, 11K spaced at regular intervals and in parallel to one another. The image forming units 11Y, 11M, 11C, 11K form toner images by employing a so-called electrophotographic system. Here, the image forming units 11Y, 11M, 11C, 11K are similarly structured except for toner contained in developing devices 16, which will be described later. The image forming units 11Y, 11M, 11C, 11K form yellow Y, magenta M, cyan C, and black K toner images, respectively. Accordingly, although suffixes "Y", "M", "C", and "K" are respectively added to elements of the image forming units 11Y, 11M, 11C, 11K for distinguishing in description hereafter, these suffixes are omitted when such distinction is not required.

Furthermore, the image forming section 10 includes an intermediate transfer belt 13 onto which toner images of the colors formed on photoconductor drums 12 are transferred. The photoconductor drums 12 will be described later. Furthermore, the image forming section 10 includes first transfer rollers 17 that sequentially transfer onto the intermediate transfer belt 13 the toner images of the colors formed by the image forming units 11. Furthermore, the image forming section 10 includes a second transfer roller 19, a fixing device 60, and an output roller 23. The second transfer roller 19 collectively transfers onto the sheet S toner images of the colors having been superposed on the intermediate transfer belt 13 (second transfer). The fixing device 60 fixes to the sheet S the toner images of the colors having been transferred through second transfer. The output roller 23 outputs the sheet S.

Here, the image forming units 11 each include a corresponding one of the photoconductor drums 12, a charger 14, a light exposure device 15, a corresponding one of the developing devices 16, and a drum cleaner 18. The photoconductor drum 12 holds a toner image. The charger 14 charges the photoconductor drum 12. The light exposure device 15 emits light toward the surface of the charged photoconductor drum 12 so as to form an electrostatic latent image. The developing device 16 develops the electrostatic latent image formed on the photoconductor drum 12 so as to form the toner image. The drum cleaner 18 removes the toner remaining on the photoconductor drum 12.

Image Forming Processes

The image forming apparatus 1 performs a series of image forming processes under the control of the controller 100. That is, a printing job transmitted from a personal computer (PC, not illustrated) or the like is subjected to an image process performed by image processing unit (not illustrated), thereby image data of the colors is produced and transmitted to the light exposure devices 15 of the image forming units 11. Then, light exposure is performed by the light exposure devices 15 and development is performed by the developing devices 16, thereby forming toner images on the photoconductor drums 12.

The toner images of the colors formed on the photoconductor drums 12 of the image forming units 11 are sequentially transferred through first transfer onto the intermediate transfer belt 13 by the first transfer rollers 17, thereby superposed toner images in which the toner images of the colors are superposed on one another on the intermediate transfer belt 13 are formed. The superposed toner images are transported toward the second transfer roller 19 as the intermediate transfer belt 13 is moved.

Meanwhile, the sheet S supplied from the sheet feed device 50 is transported to the second transfer roller 19 at timing adjusted to transport timing of superposed toner images on the intermediate transfer belt 13. Then, the superposed toner images on the intermediate transfer belt 13 are transferred through second transfer onto the sheet S by the second transfer roller 19. The superposed toner images having been transferred onto the sheet S are fixed onto the sheet S by the fixing device 60 and output by the output roller 23.

Here, the image forming apparatus 1 has a plurality of different power modes (operation modes) in which different amounts of power are consumed. As these power modes, for example, a normal mode (normal state), a standby mode, and a sleep mode (power saving state) are set. In the normal mode, images are formed in accordance with a printing job. In the standby mode, the image forming apparatus 1 stands by for image formation. In the sleep mode (power saving state), the power consumption is reduced. The power supplied to, for example, the image forming section 10 is lower in the standby mode than in the normal mode. Accordingly, the power consumption is smaller in the standby mode than in the normal mode. The power supplied to, for example, the image forming section 10 and the power consumption is lower in the sleep mode than in the standby mode.

In description hereinafter, the up-down direction (vertical direction) of the image forming apparatus 1 illustrated in FIG. 1 may be simply referred to as the "up-down direction". Furthermore, the upper side and the lower side in the up-down direction illustrated in FIG. 1 may be respectively simply referred to as the "upper side" and the "lower side". The left-right direction, in the page of FIG. 1, of the image forming apparatus 1 illustrated in FIG. 1 may be simply referred to as the "width direction". The left side and the right side in the page of FIG. 1 are respectively simply referred to as a "one side" and "another side". The depth direction, in the page of FIG. 1", of the image forming apparatus 1 illustrated in FIG. 1 may be simply referred to as the "depth direction". The front side and the rear side of the page of FIG. 1 may be respectively simply referred to as the "front side" and the "rear side".

The Fixing Device 60

Figure 2:
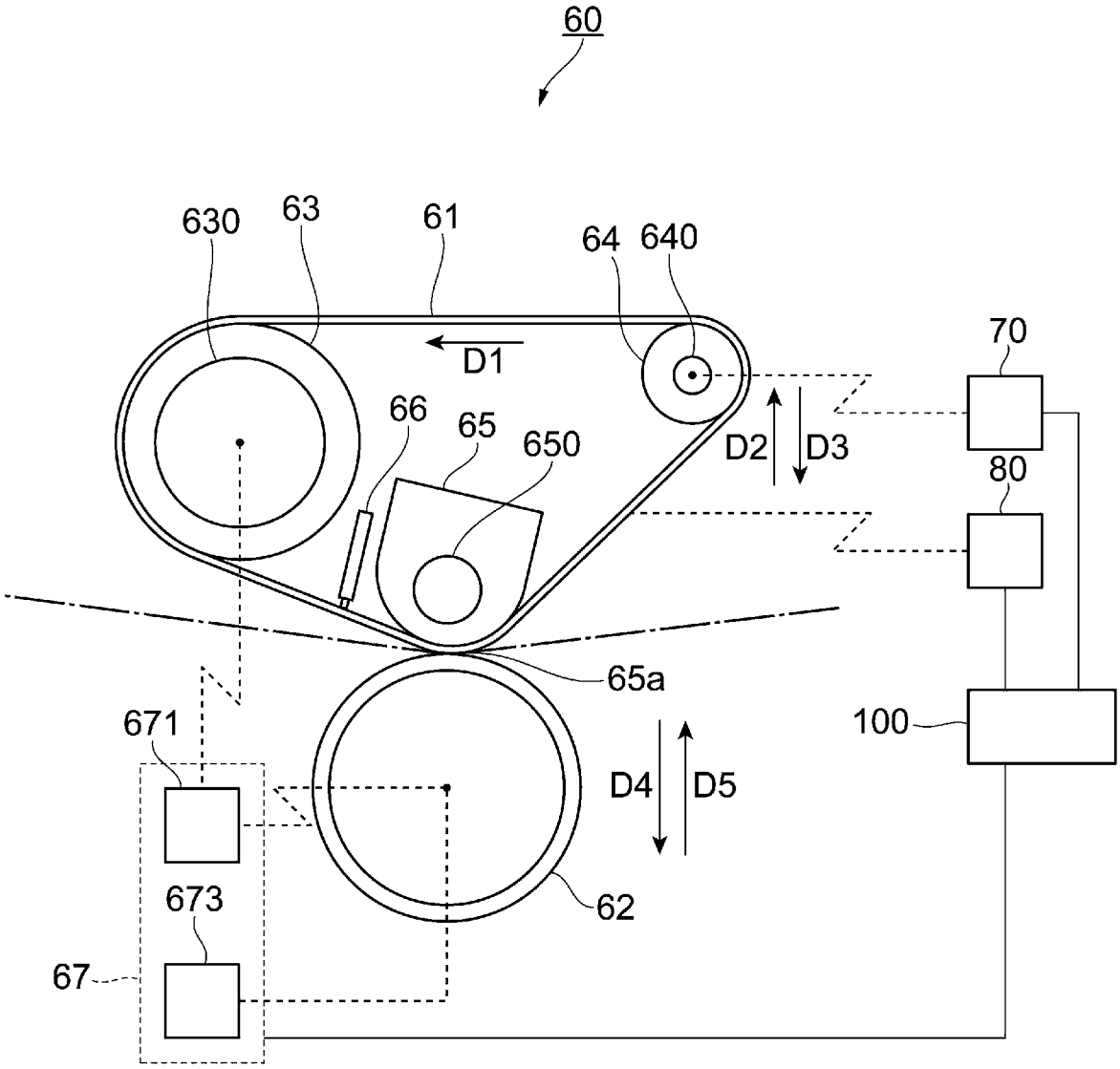
FIG. 2 is a schematic view of the structure of a fixing device to which the present exemplary embodiment is applied.

FIG. 2 is a schematic view of the structure of the fixing device 60 to which the present exemplary embodiment is applied.

Next, an outline of the structure of the fixing device 60 is described with reference to FIG. 2.

As illustrated in FIG. 2, the fixing device 60 includes a fixing belt 61, a pressure roller 62, a heating roller 63, a steering roller 64, a securing pad 65, and a lubricant applicator 66. The fixing device 60 also includes a drive unit 67, a steering controller 70, and a belt position detector 80.

The fixing belt 61 is an endless belt-shaped body and supported by the heating roller 63, the steering roller 64, and the securing pad 65 at the inner circumferential surface thereof. The fixing belt 61 is circularly moved (see an arrow D1) as the heating roller 63 and the pressure roller 62 are rotated. The fixing belt 61 has a structure in which a rubber layer and a mold release layer are provided on a base material. For example, the base material is formed of polyimide and the rubber layer is formed of silicone rubber. The mold release layer is formed of fluoroplastic such as perfluoroalkoxy alkane (PFA).

The heating roller 63 has a cylindrical shape and is formed of a metal material. The heating roller 63 includes a heater 630 disposed therein so as to heat the fixing belt 61 from the inner circumferential surface of the fixing belt 61. The coefficient of friction with an outer circumferential surface of the heating roller 63 is made to be relatively high for, for example, driving and steering the fixing belt 61.

The steering roller 64 has a cylindrical shape and formed of a metal material. The steering roller 64 includes a heater 640 disposed therein so as to heat the fixing belt 61 from the inner circumferential surface of the fixing belt 61. Here, the steering roller 64 is rotatably supported at a central portion in the width direction (depth direction) of the fixing belt 61. This allows the steering roller 64 to shake about the center at the central portion in the depth direction (see arrows D2 and D3 in FIG. 2). More specifically, a rotation axis of the steering roller 64 is able to be inclined.

The securing pad 65 is pressed against the inner circumferential surface of the fixing belt 61. The securing pad 65 is formed of, for example, a metal material and elongated in the depth direction. The securing pad 65 includes a heater 650 disposed therein so as to heat the fixing belt 61 from the inner circumferential surface of the fixing belt 61. One of side surface of the securing pad 65 facing the pressure roller 62 is a curved surface 65*a* pressed against the inner circumferential surface of the fixing belt 61. The fixing belt 61 slides against the curved surface 65*a* of the securing pad 65. The coefficient of friction with the curved surface 65*a* of the securing pad 65 is made to be relatively low. Additionally, the securing pad 65 is a sliding portion where the fixing belt 61 slides.

The lubricant applicator 66 is disposed on the inner circumferential side of the fixing belt 61 so as to apply a lubricant to the inner circumferential surface of the fixing belt 61. The lubricant increases the lubricity (reduces the coefficient of friction) and reduces the frictional force at a contact surface between the inner circumferential surface of the fixing belt 61 and the curved surface 65*a* of the securing pad 65. The lubricant illustrated in, for example, FIG. 2 is, for example, an amino-modified silicone oil. The lubricant applicator 66 is disposed between the heating roller 63 and the securing pad 65 on the inner circumferential surface of the fixing belt 61.

The pressure roller 62 is provided so as to face the securing pad 65 with the fixing belt 61 interposed therebetween. The pressure roller 62 has a structure in which a circumferential surface of a cylindrical member formed of a metal material is coated with an elastic layer formed of a rubber material. The pressure roller 62 is able to be moved toward or retracted from the securing pad 65. The pressure roller 62 applies pressure to an outer circumferential surface of the fixing belt 61 toward a surface of the securing pad 65 (for example, the curved surface 65*a*) at a position near the securing pad 65.

The drive unit 67 includes a drive motor 671 and a movement mechanism 673. The drive motor 671 is connected to the pressure roller 62 and the heating roller 63 via a gear train (not illustrated) or the like. The pressure roller 62 and the heating roller 63 are rotated by receiving a drive force from the drive motor 671 that is a drive source for both the pressure roller 62 and the heating roller 63. The movement mechanism 673 is a so-called latch mechanism. The movement mechanism 673 causes the pressure roller 62 to be moved toward or retracted from the curved surface 65*a* of the securing pad 65 (see arrows D4 and D5 illustrated in FIG. 2) by using a well-known mechanism such as a cam mechanism (not illustrated).

The steering controller 70 is connected to the steering roller 64 and supplies a drive force for inclining the rotation axis of the steering roller 64. Specifically, the steering controller 70 causes the steering roller 64 to be inclined, in accordance with the position (offset) of the fixing belt 61 in the width direction (depth direction), in the direction in which the deviation is corrected.

The belt position detector 80 detects the position of the fixing belt 61 in the width direction (depth direction). In accordance with the position of the fixing belt 61 detected by the belt position detector 80, the steering controller 70 adjusts the inclination angle of the steering roller 64.

The drive unit 67, the steering controller 70, and the belt position detector 80 are controlled by the controller 100.

Furthermore, the gear train (not illustrated) that drives the pressure roller 62 and the heating roller 63 may include a one-way clutch (not illustrated). When receiving a drive for forward rotation, this one-way clutch transmits the drive. When receiving a drive for reverse rotation, the one-way clutch idles without transmitting the drive. Thus, even when there is a difference in rotation velocity between the pressure roller 62 and the heating roller 63, slipping of the fixing belt 61 is suppressed.

Disposition of the Pressure Roller 62

Figures 3A, 3B, 3C:
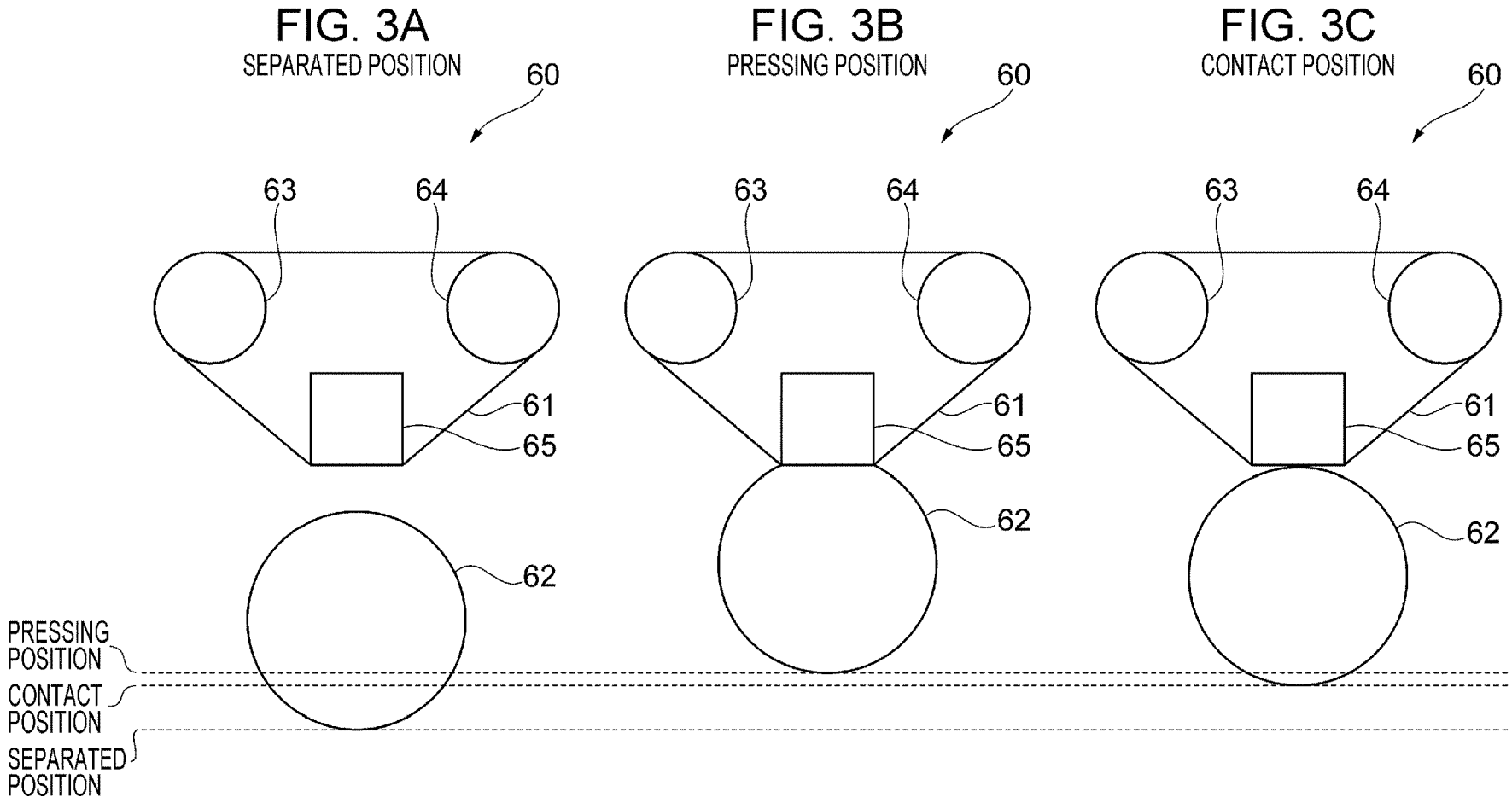
FIGS. 3A to 3C illustrate the disposition of a pressure roller.

FIGS. 3A to 3C illustrate the disposition of the pressure roller 62.

Next, the disposition of the pressure roller 62 is described with reference to FIGS. 3A to 3C.

As described above, the pressure roller 62 is moved toward or retracted from the securing pad 65 by receiving the drive from the movement mechanism 673. At this time, the pressure roller 62 is disposed one of a separated position, a pressing position, and a contact position. Hereinafter, the separated position, the pressing position, and the contact position are sequentially described.

First, the separated position is described. As illustrated in FIG. 3A, the pressure roller 62 in the separated position is separated from the fixing belt 61. No nip pressure is generated between the fixing belt 61 and the pressure roller 62 disposed at the separated position. The pressure roller 62 is disposed at the separated position in the above-described sleep mode.

Next, the pressing position is described. As illustrated in FIG. 3B, the pressure roller 62 in the pressing position is pressed against the fixing belt 61. A nip pressure is generated between the fixing belt 61 and the pressure roller 62 disposed at the pressing position. The toner images are fixed onto the sheet S transported between the pressure roller 62 and the fixing belt 61 by the nip pressure generated by the pressure roller 62 and the fixing belt 61. The pressure roller 62 is disposed at the pressing position in the above-described normal mode.

Next, the contact position is described. As illustrated in FIG. 3C, the pressure roller 62 in the contact position is in contact with the fixing belt 61. Here, the contact position is in the middle of the pressing position and the separated position. That is, the contact position is farther from the securing pad 65 than the pressing position and closer to the securing pad 65 than the separated position. A nip pressure is generated between the fixing belt 61 and the pressure roller 62 disposed at the contact position. Furthermore, the nip pressure at the contact position is smaller than that at the pressing position. The magnitude of the nip pressure at the contact position is in such a degree that, when the pressure roller 62 is rotated, no slip occurs between the pressure roller 62 and the fixing belt 61. Here, at the contact position, the pressure roller 62 is in light contact with the fixing belt 61. Also at the contact position, a pressing force of the pressure roller 62 is reduced compared to the pressing force during image formation. Although the details will be described later, the pressure roller 62 is alternately disposed at the contact position and the separated position in the standby mode.

Idling Operation of the Fixing Device 60

Next, referring to FIGS. 1 to 3C, an idling operation of the fixing device 60 is described.

For example, in order to equalize a temperature distribution in the fixing belt 61 in the case of so-called high velocity and high image quality or the like, the image forming apparatus 1 illustrated in FIG. 1 causes the fixing device 60 to idle in the standby mode. Here, the idling of the fixing device 60 refers to heating and rotating the fixing belt 61 without fixing a toner image onto the sheet S.

If the fixing belt 61 is heated and rotated after, for example, the printing job is received without idling in the standby mode, waiting time until the temperature distribution in the fixing belt 61 is equalized increases because of a relatively large thermal capacity of the fixing belt 61. Thus, in order to reduce such waiting time, the above-described idling in the standby mode is performed.

However, continuously rotating the fixing belt 61 causes the fixing belt 61 and the securing pad 65 to rub against each other as the fixing belt 61 is circularly moved, causing wear on the fixing belt 61 and the securing pad 65. Furthermore, when the time of the standby mode relatively increases, the product life of the image forming apparatus 1 may be reduced depending on a use state of the image forming apparatus 1 by the user. Accordingly, in order to reduce wear caused in the standby mode, a system with which the fixing belt 61 is intermittently rotated by intermittently switched on and off the drive motor 671 during the idling is employed.

In order to suppress wear on the fixing belt 61 and the securing pad 65 due to idling of the fixing device 60, the pressure roller 62 may be separated from the fixing belt 61. However, intermittently rotating the fixing belt 61 with the pressure roller 62 separated from the fixing belt 61, stick slip may occur when the state of the drive motor 671 is changed from an on state to an off state. This stick slip refers to a slip occurring between the heating roller 63 and the inner circumferential surface of the fixing belt 61 when the heating roller 63 having been stopped is started to be rotated. When the stick slip occurs, the fixing belt 61 and the heating roller 63 are worn. In addition, when the lubricant is supplied to the inner circumferential surface of the fixing belt 61 by using the lubricant applicator 66 as described above, stick slip more easily occurs. Furthermore, since the number of times the drive motor 671 is switched on increases in the standby mode, chances to undergo stick slip increases. This may increase wear.

Thus, according to the present exemplary embodiment, when the drive motor 671 is started up in the standby mode, the pressure roller 62 is brought into contact with the fixing belt 61. In this state, the drive motor 671 is started up and rotates the pressure roller 62. Furthermore, after a predetermined amount of time has been elapsed, the fixing belt 61 is further rotated with the pressure roller 62 disposed at the separated position. Thus, the fixing belt 61 is driven not only by the heating roller 63 disposed on the inner circumferential side thereof but also by receiving drive from the pressure roller 62. With this structure, the belt velocity of the fixing belt 61 may be stabilized and stick slip between the heating roller 63 and the inner circumferential surface of the fixing belt 61 may be reduced.

Furthermore, in the example illustrated in, for example, FIGS. 1 to 3C, the drive motor 671 is intermittently switched on and off. This may reduce driving time of the drive motor 671 while maintaining the equalized temperature distribution in the fixing belt 61. Furthermore, in the example illustrated in, for example, FIGS. 1 to 3C, the amount of wear on the fixing belt 61 and the heating roller 63 may be reduced. Here, in the example, illustrated in, for example, FIGS. 1 to 3C, the heating roller 63 supplies the drive force to the inner circumferential surface of the fixing belt 61 with the lubricant applied therebetween. In contrast, the pressure roller 62 supplies the drive force to the outer circumferential surface of the fixing belt 61 without the lubricant applied therebetween.

Control of the Drive Unit 67

Figure 4A:
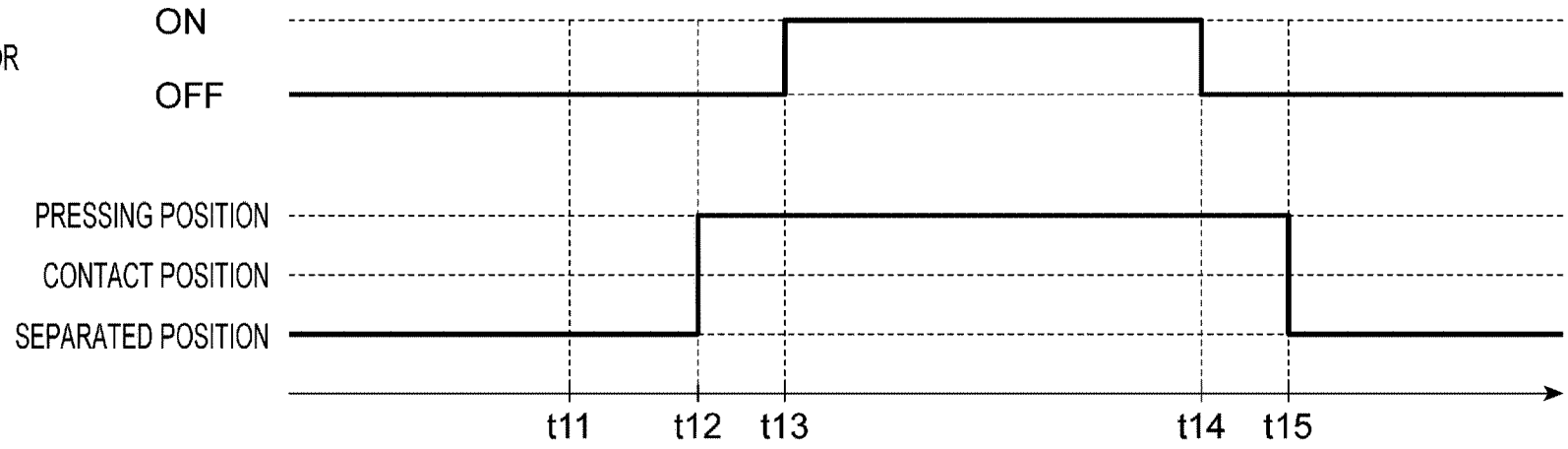
FIGS. 4A and 4B are timing charts illustrating control of a drive unit.
Figure 4B:
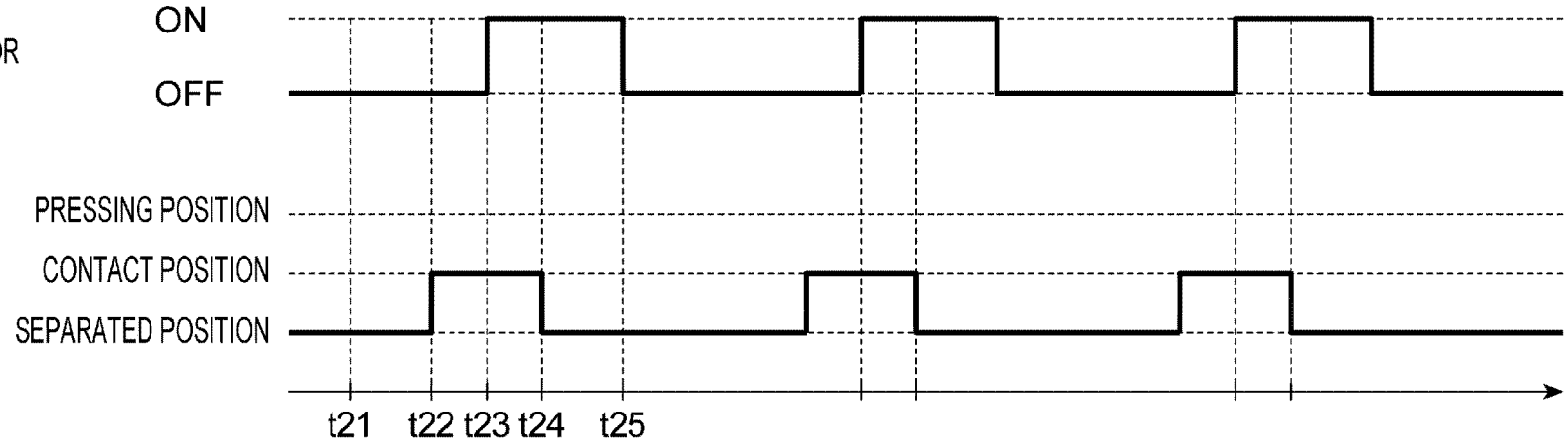

FIGS. 4A and 4B are timing charts illustrating control of the drive unit 67. More specifically, FIG. 4A illustrates a timing chart at a time of a startup, and FIG. 4B illustrates a timing chart in the standby mode.

FIGS. 5A to 5E illustrate operations of the fixing device 60 at the time of the startup.

FIGS. 6A to 6E illustrate operations of the fixing device 60 in the standby mode.

In FIGS. 5A to 5E and 6A to 6E, the pressure roller 62 and the heating roller 63 being rotated by receiving the drive from the drive motor 671 are hatched.

Next, referring to FIGS. 4A to 6E, the control of the drive unit 67 at the time of the startup and in the standby mode is described. Here, the time of the startup refers to timing when the power mode of the image forming apparatus 1 is switched from the sleep mode to the normal mode. At the time of the startup illustrated in, for example, FIGS. 4A and 5A to 5E, control under which the drive motor 671 is intermittently switched on and off is not performed. In contrast, in the standby mode, the control under which the drive motor 671 is intermittently switched on and off is performed.

At the Time of the Startup

First, referring to FIGS. 4A and 5A to 5E, the control of the drive unit 67 at the time of the startup is described. Here, as an initial state, as indicated by time t11 in FIG. 4A, it is assumed that the drive motor 671 is in the off state ("OFF" in FIG. 4A) and the pressure roller 62 is at the separated position. At this time, as illustrated in FIG. 5A, the pressure roller 62 is separated from the fixing belt 61.

Then, at time t12, the pressure roller 62 is moved from the separated position to the pressing position (see an arrow D5 illustrated in FIG. 5B). As a result of this, the pressure roller 62 is pressed against the fixing belt 61. The drive motor 671 continues to be in the off state (see FIG. 4A).

Then, at time t13, the drive motor 671 is switched from off to on ("ON" in FIG. 4A). As a result of this, as illustrated in FIG. 5C, the pressure roller 62 and the heating roller 63 are started to be rotated, thereby circularly moving the fixing belt 61 (see an arrow D1).

Then, at time t14, the drive motor 671 is turned from on to off. As a result of this, as illustrated in FIG. 5D, the pressure roller 62 and the heating roller 63 stop being rotated, thereby the fixing belt 61 stops the circular move. At this time, the pressure roller 62 is still disposed at the pressing position.

Then, at time t15, the pressure roller 62 is moved to the separated position (see an arrow D4 illustrated in FIG. 5E). As a result of this, the pressure roller 62 is separated from the fixing belt 61.

As has been described, at the time of the startup, where the control under which the drive motor 671 is intermittently switched on and off is not performed, the fixing belt 61 is circularly moved while the pressure roller 62 is disposed at either the separated position or the pressing position.

The amount of time from the time t13 to the time t14 is, for example, 15 seconds. That is, the drive motor 671 is turned off after a predetermined amount of time has elapsed from when the drive motor 671 is turned on. During the predetermined amount of time, the fixing belt 61 is able to be rotated a plurality of times (for example, five times).

The Standby Mode

Next, referring to FIGS. 4B and 6A to 6E, the control of the drive unit 67 in the standby mode is described. In the standby mode, the drive motor 671 is intermittently switched on and off as described above. For example, a cycle of the on state of the drive motor 671 for three seconds and then the off state of the drive motor 671 for eight seconds is repeated during the standby mode. In the duration of the on state (for example, three seconds), the fixing belt 61 is able to be rotated, for example) once.

Here, as an initial state, as indicated by time t21 in FIG. 4B, it is assumed that the drive motor 671 is in the off state and the pressure roller 62 is at the separated position. At this time, as illustrated in FIG. 6A, the pressure roller 62 is separated from the fixing belt 61.

Then, at time t22, the pressure roller 62 is moved from the separated position to the contact position (see an arrow D5 illustrated in FIG. 6B). As a result of this, the pressure roller 62 is pressed against the fixing belt 61. The drive motor 671 continues to be in the off state (see FIG. 4B).

Then, at time t23, the drive motor 671 is switched from off to on. As a result of this, as illustrated in FIG. 6C, the pressure roller 62 and the heating roller 63 are started to be rotated, thereby circularly moving the fixing belt 61 (see an arrow D1). A smaller nip pressure than a largest nip pressure for image formation is applied at the contact position. This may suppress damage to the fixing belt 61.

Then, at time t24, the pressure roller 62 is moved from the contact position to the separated position. As a result of this, as illustrated in FIG. 6D, the pressure roller 62 is separated from the fixing belt 61. At this time, the drive motor 671 is in the on state, and the fixing belt 61 that receives the drive from the heating roller 63 continues to be circularly moved. Since the fixing belt 61 continues to be rotated, the temperature distribution in the fixing belt 61 is further equalized. At the time t24, the pressure roller 62 is separated from the fixing belt 61. Thus, the state of the fixing belt 61 is changed from a state in which the fixing belt 61 receives the drive from the pressure roller 62 and the heating roller 63 to a state in which the fixing belt 61 receives the drive from the heating roller 63 and does not receive the drive from the pressure roller 62.

Then, at time t25, the drive motor 671 is switched from on to off. As a result of this, as illustrated in FIG. 6E, the pressure roller 62 and the heating roller 63 stop being rotated, thereby the fixing belt 61 stops the circular move.

In the example illustrated in, for example, FIG. 4A to 6E, the amount of time during which the drive motor 671 is on in the standby mode (from the time t23 to the time t25) is smaller than the amount of time during which the drive motor 671 is on at the time of the startup (from the time t13 to the time t14). Furthermore, the amount of time during which the pressure roller 62 is disposed at the contact position and rotated in the standby mode (from the time t23 to the time t24, for example, one second) is smaller than the amount of time during which the pressure roller 62 is disposed at the separated position and rotated in the standby mode (from the time t24 to the time t25, for example, two seconds). Furthermore, the amount of time during which the pressure roller 62 is disposed at the contact position in the standby mode (from the time t22 to the time t24) is smaller than the amount of time during which the drive motor 671 is on in the standby mode (from the time t23 to the time t25).

At the time t24, the pressure roller 62 is moved to the separated position and separated from the fixing belt 61. This may suppress an increase in temperature of the pressure roller 62. Additionally, separating the pressure roller 62 from the fixing belt 61 may facilitate an increase in temperature of the fixing belt 61.

Timing at which the pressure roller 62 is moved from the contact position to the separated position at the time t24 is timing at which predetermined conditions are satisfied. Here, examples of the predetermined conditions include time (for example, the amount of time elapsed from the time t23), the velocity of the fixing belt 61 (for example, the velocity becomes higher than or equal to a predetermined velocity), and so forth. The predetermined conditions may be varied depending on drive torque (motor current value), the temperature of the fixing belt 61, a running print value (PV) that is an accumulated number of prints, the type of the sheet S (for example, cardboard or thin paper), and so forth. This may suppress stick slip even in the case where, for example, the amount of time required to stabilize the velocity of the fixing belt 61 varies due to changes in the drive torque.

Another Exemplary Embodiment

FIGS. 7A to 7F illustrate operations of the fixing device 60 in the standby mode according to another exemplary embodiment.

Next, referring to FIGS. 7A to 7F, the operations of the fixing device 60 in the standby mode according to the other exemplary embodiment is described. In FIGS. 7A to 7F, the pressure roller 62 and the heating roller 63 being rotated by receiving the drive from the drive source are hatched. Furthermore, in the following description, description of the same elements as those of the above-described exemplary embodiment may be omitted by denoting the same elements by the same reference signs.

First, in the above-described fixing device 60, the heating roller 63, the steering roller 64, the securing pad 65, and the lubricant applicator 66 are disposed on the inner circumferential side of the fixing belt 61. However, this is not limiting. For example, at least one of the steering roller 64, the securing pad 65, and the lubricant applicator 66 may be omitted.

Furthermore, although the pressure roller 62 and the heating roller 63 are rotated by receiving the drive from the drive motor 671 that is the drive source for both the pressure roller 62 and the heating roller 63 in the above description, this is not limiting. For example, the pressure roller 62 and the heating roller 63 may be driven by respective different drive sources.

Figures 7A, 7B, 7C, 7D, 7E, 7F:
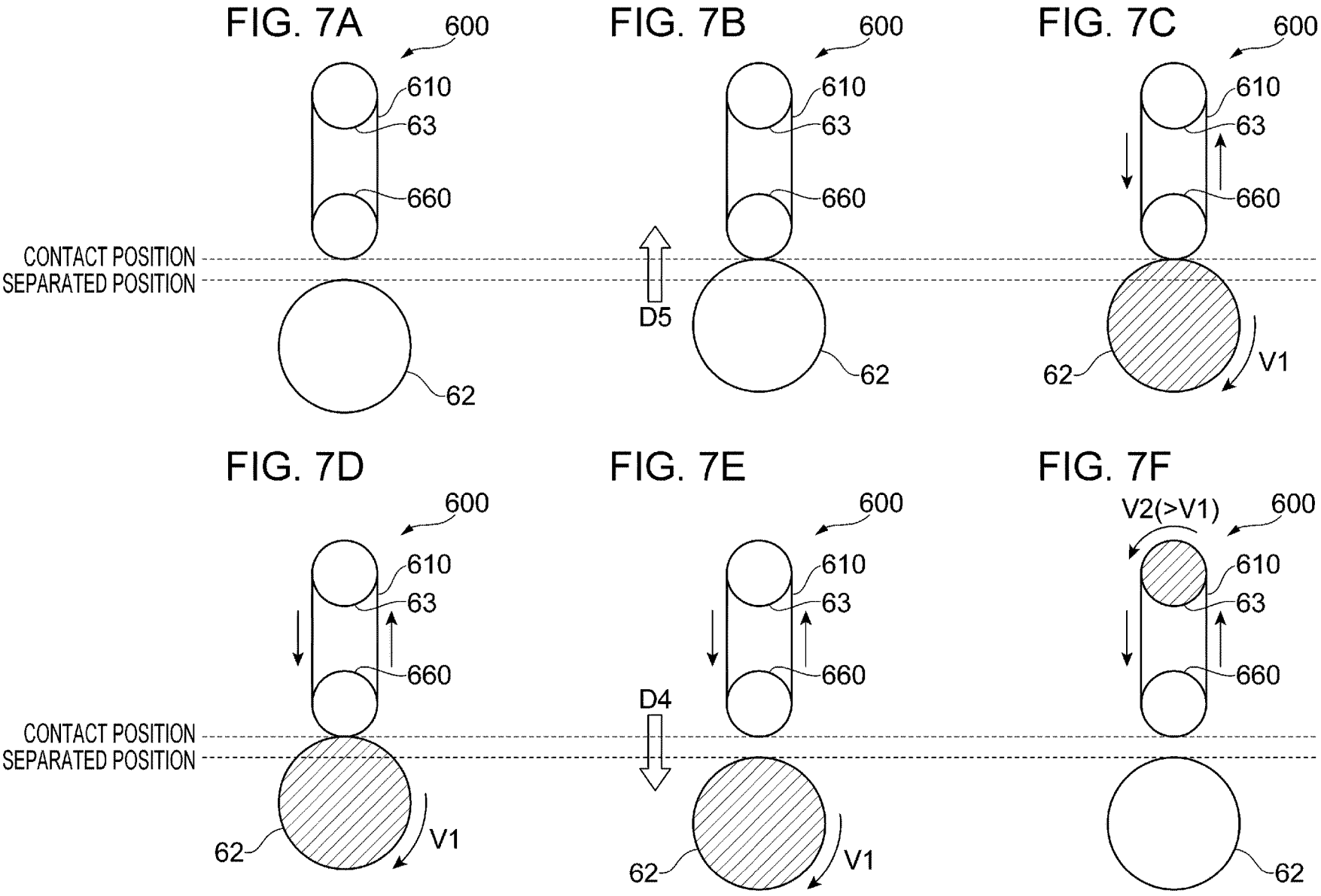
FIGS. 7A to 7F illustrate operations of the fixing device in the standby mode according to another exemplary embodiment.

Specifically, for example, such a structure as the structure of a fixing device 600 illustrated in FIG. 7A is acceptable. The fixing device 600 includes a fixing belt 610 serving as an example of a stretched belt, the heating roller 63, a pressure contact member 660, and the pressure roller 62. The fixing belt 610 is supported by the heating roller 63 and the pressure contact member 660 from the inner circumferential surface thereof. Furthermore, the pressure roller 62 and the heating roller 63 are driven by respective drive sources (not illustrated). Furthermore, the pressure roller 62 is provided opposite to the pressure contact member 660 with the fixing belt 610 interposed therebetween. The pressure roller 62 is disposed at one of the separated position, the pressing position, and the contact position.

Next, operations of the fixing device 600 is described. Here, as an initial state, as illustrated in FIG. 7A, it is assumed that the pressure roller 62 is at the separated position. It is also assumed that neither the pressure roller 62 nor the heating roller 63 is not rotated.

Then, as illustrated in FIG. 7B, the pressure roller 62 is moved from the separated position to the contact position (see an arrow D5). As a result of this, the pressure roller 62 is brought into contact with the fixing belt 610.

Next, as illustrated in FIG. 7C, the drive source (not illustrated) of the pressure roller 62 is switched from off to on. As a result of this, the fixing belt 610 is started to be circularly rotated. At this time, a circumferential velocity of the pressure roller 62 is a circumferential velocity V1. Furthermore, the heating roller 63 does not receive the drive from the drive source (not illustrated) thereof and is rotated due to the movement of the fixing belt 610.

Next, as illustrated in FIG. 7D, after a predetermined amount of time has elapsed, the circumferential velocity of the fixing belt 610 increases and the fixing belt 610 is circularly moved at the circumferential velocity V1 of the pressure roller 62. At this time, the heating roller 63 does not receive the drive force from the drive source (not illustrated) thereof.

Next, as illustrated in FIG. 7E, the pressure roller 62 is moved from the contact position to the separated position (see an arrow D4). As a result of this, the pressure roller 62 is separated from the fixing belt 610.

Then, as illustrated in FIG. 7F, the drive source (not illustrated) of the heating roller 63 is switched from off to on. As a result of this, the heating roller 63 is rotated by receiving the drive force from the drive source (not illustrated) thereof. Also, the drive source (not illustrated) of the pressure roller 62 is switched from on to off.

Here, the circumferential velocity of the heating roller 63 being rotated by receiving the drive force from the drive source (not illustrated) thereof is a circumferential velocity V2. That is, the heating roller 63 rotates the fixing belt 610 at a higher velocity than the velocity at which the fixing belt 610 is driven by the pressure roller 62 as illustrated in FIG. 7C. When gradually increasing the velocity of the fixing belt 610 so as to rotate the fixing belt 610 at high velocity as described above, slip due to acceleration of the fixing belt 610 may be suppressed. Furthermore, the heating roller 63 is started to be driven after the pressure roller 62 has been separated. This may suppress slipping of the fixing belt 610 even when there is a difference in drive velocity between the pressure roller 62 and the heating roller 63.

Unlike the above-described example, the drive source (not illustrated) of the heating roller 63 may be switched from off to on so as to be started to rotate the heating roller 63 when the pressure roller 62 is moved from the contact position to the separated position (see FIG. 7E).

Variations

In the above description, at the time of the startup at which the power mode of the image forming apparatus 1 is switched from the sleep mode to the normal mode, the pressure roller 62 is moved from the separated position to the pressing position and rotated. However, the pressure roller 62 may be moved from the separated position to the contact position and rotated.

Furthermore, in the above description, the pressure roller 62 presses the outer circumferential surface of the fixing belt 61. However, instead of the pressure roller 62, an external heating roller that includes a heater therein may be used. In this case, the external heating roller transmits the drive force to the fixing belt 61 while pressing the outer circumferential surface of the fixing belt 61.

In the above description, the fixing belt 61 serves as an example of a belt member, the heating roller 63 serves as an example of an inner circumferential rotating body, the pressure roller 62 serves as an example of an outer circumferential rotating body, the securing pad 65 serves as an example of a pressing member, and the drive unit 67 serves as an example of a rotation starter.

Although the various exemplary embodiments and the variations have been described, of course, these exemplary embodiments and variations may be combined to one another.

Furthermore, the present disclosure is not limited to the above-described exemplary embodiments and may be embodied in various forms without departing from the gist of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device comprising:

a belt member that has an inner circumferential surface and an outer circumferential surface and that fixes an image formed on a recording medium;

an inner circumferential rotating body over which the inner circumferential surface of the belt member is looped and which rotates the belt member;

an outer circumferential rotating body that is movable between a contact position at which the outer circumferential rotating body is in contact with the outer circumferential surface of the belt member and a separated position at which the outer circumferential rotating body is separated from the outer circumferential surface of the belt member, the outer circumferential rotating body rotating the belt member when the outer circumferential rotating body is disposed at the contact position; and a rotation starter that moves the outer circumferential rotating body toward the separated position and rotates the belt member by using the inner circumferential rotating body after the rotation starter has rotated the belt member by using the outer circumferential rotating body disposed at the contact position when the belt member is started to be rotated.

2. The fixing device according to claim 1, wherein, when a predetermined condition is satisfied after the rotation starter has rotated the belt member by using the outer circumferential rotating body disposed at the contact position, the outer circumferential rotating body is moved toward the separated position.

3. The fixing device according to claim 2, wherein the predetermined condition is elapse of a predetermined amount of time from when the rotation of the belt member by using the outer circumferential rotating body is started.

4. The fixing device according to claim 1, wherein rotation of the inner circumferential rotating body is stopped before the outer circumferential rotating body is started to be rotated.

5. The fixing device according to claim 4, wherein the inner circumferential rotating body is started to be rotated after the outer circumferential rotating body has been started to be rotated.

6. The fixing device according to claim 1, further comprising:

a pressing member that allows, when the belt member is being rotated, the inner circumferential surface of the belt member to slide against the pressing member while the pressing member is pressing the inner circumferential surface of the belt member.

7. The fixing device according to claim 1, wherein, when the outer circumferential rotating body is moved toward the separated position, a rotation velocity of the outer circumferential rotating body is lower than a rotation velocity of the inner circumferential rotating body.

8. The fixing device according to claim 1, wherein a pressure at which the outer circumferential rotating body is pressed against the outer circumferential surface of the belt member is smaller when the belt member is started to be rotated than when the belt member fixes the image to the recording medium.

9. A fixing device comprising:

a belt member that has an inner circumferential surface and an outer circumferential surface and that fixes an image formed on a recording medium;

an inner circumferential rotating body over which the inner circumferential surface of the belt member is looped and which rotates the belt member; and an outer circumferential rotating body a state of which is switchable between a state in which the outer circumferential rotating body is pressed against the outer circumferential surface of the belt member and a state in which the outer circumferential rotating body is separated from the outer circumferential surface of the belt member, the outer circumferential rotating body rotating the belt member when the outer circumferential rotating body is in the state in which the outer circumferential rotating body is pressed against the outer circumferential surface of the belt member, wherein, when the belt member is stopped, the outer circumferential rotating body is separated from the outer circumferential surface of the belt member, wherein, when the belt member is rotated so as to fix the image to the recording medium, the outer circumferential rotating body is pressed against the outer circumferential surface of the belt member, and wherein a pressure at which the outer circumferential rotating body is pressed against the outer circumferential surface of the belt member is smaller when the belt member is started to be rotated than when the belt member fixes the image to the recording medium.

10. An image forming apparatus comprising:

an image forming section that forms an image on a recording medium;

a belt member that has an inner circumferential surface and an outer circumferential surface and that fixes the image formed by the image forming section to the recording medium;

an inner circumferential rotating body over which the inner circumferential surface of the belt member is looped and which rotates the belt member;

an outer circumferential rotating body that is movable between a contact position at which the outer circumferential rotating body is in contact with the outer circumferential surface of the belt member and a separated position at which the outer circumferential rotating body is separated from the outer circumferential surface of the belt member, the outer circumferential rotating body rotating the belt member when the outer circumferential rotating body is disposed at the contact position; and a rotation starter that moves the outer circumferential rotating body toward the separated position and rotates the belt member by using the inner circumferential rotating body after the rotation starter has rotated the belt member by using the outer circumferential rotating body disposed at the contact position when the belt member is started to be rotated.

* * * * *